United States Patent [19]

Staufer

[11] 4,440,418

[45] Apr. 3, 1984

[54] SKI BASE COATING

[75] Inventor: Adolf Staufer, Molln, Austria

[73] Assignee: TRAK Sportartikel GmbH, Fed. Rep. of Germany

[21] Appl. No.: 306,658

[22] Filed: Sep. 29, 1981

[30] Foreign Application Priority Data

Oct. 2, 1980 [AT] Austria ..... 4921/80

[51] Int. Cl.[3] ..... A63C 7/06

[52] U.S. Cl. ..... 280/604; 280/610

[58] Field of Search ..... 280/604, 609, 610

[56] References Cited

U.S. PATENT DOCUMENTS

| | | | |
|---|---|---|---|
| 3,408,086 | 10/1968 | Bennett | 280/604 |
| 3,858,894 | 11/1975 | Ver | 280/604 |
| 4,223,909 | 9/1980 | Danner | 280/604 |

FOREIGN PATENT DOCUMENTS

| | | | |
|---|---|---|---|
| 808359 | 11/1936 | France | |
| 2382909 | 10/1978 | France | |
| 1954075 | 10/1969 | Fed. Rep. of Germany | |
| 2543712 | 4/1977 | Fed. Rep. of Germany | |
| 7831297 | 10/1978 | Fed. Rep. of Germany | 280/604 |

*Primary Examiner*—David M. Mitchell
*Assistant Examiner*—Joseph McCarthy
*Attorney, Agent, or Firm*—Richard P. Crowley

[57] ABSTRACT

A ski base coating including an embossed push-off aid which consists of a plurality of steps having steep gradient push-off flanks (1', 1'', 3) in push-off direction and flat angle ramps in gliding direction. The upper side of the steps is formed of a continuous honeycomb arrangement of equilateral or biaxially symmetric hexagonal fields (2', 2''). For improved push-off effect the fields (2', 2'') are so arranged that one of the hexagon sides (1', 1'') each extends transversely of the push-off direction, that this hexagon side (1', 1'') is designed as push-off edge, and that the hexagon faces form the flat angle step ramps. (FIG. 1)

21 Claims, 6 Drawing Figures

TABLE FIG.6

| | l | a | b | c | n |
|---|---|---|---|---|---|
| A | 197.45 | 6 | 12 | 10.39 | 19 |
| B | 96 | 6 | 12 | 12.0 | 8 |
| C | 98 | 6 | 12 | 14.0 | 7 |
| D | 104 | 6 | 12 | 16.0 | 6.5 |
| G | 793.45 | | | | |

SKI BASE COATING

The instant invention relates to a ski base coating including an embossed push-off aid which consists of a plurality of steps having steep gradient push-off flanks in push-off direction and flat angle ramps in gliding direction, the upper side of the steps being formed of a continuous honeycomb arrangement of equilateral or biaxially symmetric hexagonal fields, and to a method of producing the same.

BACKGROUND OF THE INVENTION

Many attempts have been made to devise climbing or push-off aids embossed or stamped in the base coating or base layer of skis, which would provide not only the optimum harmony between push-off and gliding behavior and sufficient lateral guidance and smoothness when skiing over hard, grooved tracks but also be producible economically and permit economic production of the embossing or stamping tools required.

Austrian Pat. No. 291 063, which corresponds to U.S. Pat. No. 3,408,086, discloses a step arrangement, including rows of steps extending transversely and having arcuate edges, the individual arc sections being directly contiguous, and rows of steps arranged one behind the other and being laterally offset, preferably by half the step width. This arrangement has the disadvantage of having acute angle corners between the arcuate sections in which snow and ice may accumulate thus reducing the push-off capability accordingly. Moreover, there are no push-off edges which extend at right angles to the push-off direction so that the optimum transmission of the push-off forces is not obtained. Although guidance against lateral slip-off is given, it is available only until the corners mentioned have become filled with snow.

DE-OS No. 29 27 756 discloses a step arrangement having rectilinear step edges perpendicular to the push-off direction, and step flanks at flat angles formed of concave or convex surface sections of overlapping surfaces of revolution. This arrangement has no acute angle intersections in which snow could become stuck. Moreover, the resulting undulated transverse profile affords sufficient lateral guidance. However, as the step ramps which are inclined at flat angles are sections of surfaces of revolution, all gliding faces are curved in transverse direction and, therefore, do not provide optimum support on the track. This is felt as worse gliding behavior, particularly on soft tracks. Besides, it results in uneven wear because surface area parts project even if the curvatures or intersections are very flat.

Swiss Pat. No. 189 670 discloses a ski provided with a base coating which comprises an arrangement of embossed fields of parallelogram shape serving as a push-off aid and being defined by two intersecting families of parallel edges extending at an angle of less than 90° with respect to the longitudinal axis of the ski. The diagonals of these fields extend in longitudinal direction of the ski so that the push-off edges disposed obliquely to the longitudinal direction of the ski intersect at acute angles. It is known from experience that such intersections fill up easily with ice or snow, whereby the push-off effect is reduced accordingly. As no push-off edge is disposed transversely of the push-off direction, the push-off which can be transmitted is not the best.

Austrian Pat. No. 348 386 discloses a base coating having an embossed profile which consists of fields, similar to those according to Swiss Pat. No. 189 690, which are defined by a plurality of intersecting families of parallel delimitation lines. Although several characteristic differences exist with respect to Swiss Pat. No. 189 690, the disadvantages mentioned still persist.

DE-AS No. 22 43 229, which corresponds to U.S. Pat. No. 3,858,894, discloses a base design for cross-country skis which consists of a pattern of scale-like projections protruding from the base surface. At least some of these projections have straight edges at their sides, and at least one of these edges is inclined at an angle with respect to the longitudinal axis of the ski and one edge extends transversely of the longitudinal axis of the ski. The individual projections of a transverse row are separated from one another by narrow, acute angle depressions which may become filled with snow or ice and thus become ineffective. A specific method and a relatively complicated tool are required for manufacture of this base. Besides, projections which protrude beyond the base surface require particular measures to be taken in the manufacture of the ski.

German utility model DE-GM No. 7 831 297, finally, discloses a base coating having an embossed push-off aid which consists of a plurality of steps having steep gradient push-off flanks in push-off direction and flat angle ramps in gliding direction, the upper side of the steps being formed of a continuous honeycomb arrangement of equilateral or biaxially symmetric hexagonal fields.

This known base coating makes allowance for the recognition that, as a rule, the gliding times are much longer than the braking times. This is accomplished in that the overall length available per step is divided in corresponding proportions into a gliding zone and a climbing zone. Yet as the proposed arrangement of the hexagon fields is such that the tips are oriented either to the front or to the rear, again there is the risk that snow and ice will accumulate in the corners between two adjacent steps.

It is another disadvantage of the arrangement described of the hexagon fields that only push-off edges are provided which are inclined with respect to the push-off direction, and this has the consequence of reduced push-off effect. Furthermore, the guide bars provided in the known base coating and extending in skiing direction between two adjacent hexagon fields each, require extremely expensive embossing tools, and it is doubtful if such increased expenditure is worthwhile when considering the effect of the guide bars.

It is, therefore, an object of the present invention to provide a ski base coating in which a push-off aid is embossed to guarantee the optimum transmission of push-off forces and good lateral guidance. It is another object of the invention to provide a ski base coating of such kind that any plugging of the effective steps by ice and snow is substantially reduced. Moreover, it is an object of the invention to provide a kind of base coating for skis which permits simple and economic manufacture of the embossing tool used.

SUMMARY OF THE INVENTION

These and other objects which will become apparent as the specification proceeds, are met in accordance with the invention by the provision of a ski base coating patterned such that hexagonal fields are so arranged that one of the hexagon sides each extends transversely of the push-off direction, that this hexagon side is designed as push-off edge, and that the hexagon faces form flat angle step ramps.

Surprisingly, the design of the invention, devised for the ski base coating, does serve to solve the rather complex problem which the inventor set out to resolve, even providing the optimum solution. As compared to the solution according to DE-GM No. 7 831 297 which, at first glance seems quite similar, the ski base coating according to the invention is characterized in particular by a much enlarged effective push-off edge at the same width of the base coating. Also the embossing of the base coating according to the invention causes much less difficulties than the embossing of the base coating according to the cited German utility model. There is no risk either that snow or ice will become stuck in the embossed pattern.

Preferably, the upper side of the individual steps is differently inclined or curved in longitudinal direction in different sections of its length. In this way an improved gliding behavior of the ski base coating is obtained.

The optimum transmission of push-off forces is obtained if push-off edges are also presented by at least partial sections of the hexagon sides extending obliquely to the push-off direction adjacent those hexagon sides which extend transversely of the push-off direction and are formed as push-off edges.

The embodiment wherein the side length of the hexagon sides formed as push-off edges is between 4 and 15 mm is particularly well suited for cross-country skis which have a width of less than 55 mm in the central range of the ski.

A ski base coating of the invention is produced by embossing, using an embossing tool disposed in a flat plane, wherein the embossing die is composed of individual parts of a hexagonal cross-section forming a honeycomb, the cross-section corresponding to the shape of the fields of the push-off aid, and the front side of said parts being designed in correspondence with the inclination or curvature of the fields. In the method of embossing, a roller-shaped embossing tool may be used, wherein the embossing roller is composed of similar discs having a width which corresponds to the diagonal spacing transversely of the push-off direction of the hexagon faces, having front faces which are profiled in correspondence with the hexagon sides extending obliquely to the push-off direction, and having a circumferential surface which is designed in correspondence with the side spacing in the push-off direction, the step depth and the conditions of inclination or curvature of the hexagon sides. The method according to the invention permits simple and economic manufacture, using uncomplicated planar or roller-shaped embossing tools.

BRIEF DESCRIPTION OF THE DRAWINGS

The invention will be described further, by way of example, with reference to the accompanying drawings, in which:

FIG. 6 is a table corresponding to the ski base coating shown in FIG. 5.

DESCRIPTION OF THE EMBODIMENTS

Figure 1:
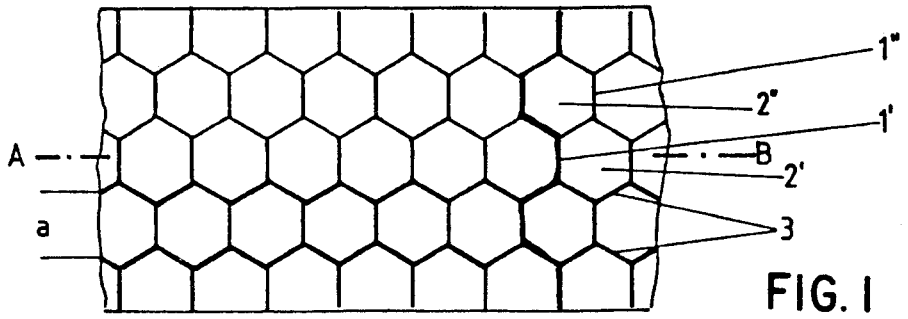
FIG. 1 is a partial plan view from below of a ski base coating in accordance with the invention.

The embodiment according to FIG. 1 shows the hexagon surfaces to be equilateral. The longitudinal direction of the coating or ski is from left to right in the drawing. The hexagon sides 1' extending transversely of the longitudinal direction and the hexagon sides 1'' which are offset from the same by half a side spacing are designed as step edges. The hexagon faces 2' and the hexagon faces 2'' which are offset from the same by half a side spacing are designed as flat angle step ramps. In accordance with the inclination or curvature of the hexagon faces 2' or 2'' at least part sections of the hexagon sides 3 extending obliquely to the push-off direction likewise are designed as steep gradient step edges adapted to transmit tangential forces.

Figure 2:
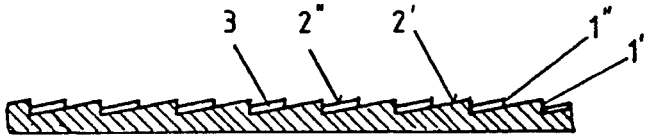
FIGS. 2 and 3 show different embodiments of step ramps as seen in cross section along line A-B of FIG. 1.

This is clearly shown in FIG. 2 which is a cross section along line A-B in FIG. 1. The step edges 1' which drop steeply are offset in longitudinal direction by half a side spacing with respect to similar edges 1''. The hexagon faces 2' and 2'', respectively, are sloped at a constant angle of inclination across their longitudinal extent until they reach the desired step depth which, preferably, is between 0.1 and 1.0 mm. It is clearly seen that also the hexagon sides 3 disposed obliquely to the push-off direction constitute push-off edges having a flank portion which transmits forces in tangential direction. Thus a two-dimensionally interconnected network is obtained which forms push-off edges along all sides of the hexagon and consists of faces which transmit forces in tangential direction and the height of which is determined by the depth of the steps. A great part of all push-off edges extends vertically to the push-off direction whereby very effective push-off is warranted. The push-off edges which are disposed obliquely to the push-off direction afford very good lateral guidance since they are disposed symmetrical with respect to the push-off direction. There are no acute angle intersections which could become filled with ice or snow to reduce the push-off effect.

Figure 3:
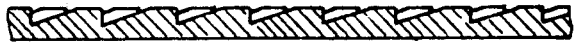

FIG. 3 shows another embodiment of the subject invention in cross section along line A-B of FIG. 1. In this case the hexagon faces are not sloped at a constant inclination but instead lie partly in the plane of contact of the coating with the track, to be inclined thereafter. In this manner a distinct gliding surface is formed at the upper side of the step edges, and the dimensions thereof may be enlarged so as to cover an essential part of the entire hexagonal surface. This permits variation of the gliding behavior within wide limits.

Furthermore, the hexagonal surfaces may be curved in longitudinal direction to provide an especially smooth transition guaranteeing very good gliding behavior. For instance, the bend resulting in the FIG. 3 embodiment at the intersection of surface portions having different inclinations could be alleviated by a convex curvature.

Figure 4:
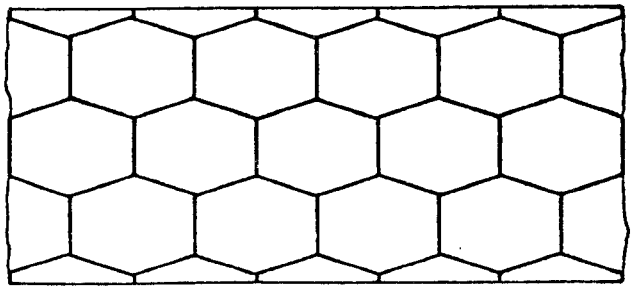
FIG. 4 is a partial plan view from below of another embodiment of a ski base coating according to the invention.

FIG. 4 is a view from below of another embodiment of the subject matter of the invention. The hexagon fields are not equilateral but instead only biaxially symmetrical, thus having a greater length than width. In this way a particularly flat rise of the hexagon faces may be selected so that this particular embodiment offers very smooth gliding properties. It would also be conceivable to make the width greater than the length.

If the hexagon sides constituting the push-off edges have a side length between 4 and 15 mm, the ski base coating according to the invention is especially well suited for cross-country skis having a width in the central range of the ski of less than 55 mm.

As shown in FIGS. 1 and 4, the hexagon fields, preferably, are so disposed that push-off edges extending transversely of the push-off direction are located in both marginal zones of the coating.

Apart from the functional advantages of the ski base coating according to the invention, as compared to the known solutions, another favorable aspect is the highly economical manufacture thereof. While embossing tools usually are made in one piece by engraving, a complicated and expensive procedure, the embossing tools used for the coating according to the invention may be combined of individual similar elements. A plane die, for example, may be composed of individual components of hexagonal cross section, the dimensions of which correspond to the hexagon fields of the coating, and the front face of which is designed in correspondence with the gradient and curvature of the flat-angle step ramp. An embossing roller may be combined in simple manner of individual, similar discs the width of which corresponds to the length of the diagonal extending transversely of the push-off direction and the front faces of which are sectioned in correspondence with the hexagon sides disposed obliquely to the push-off direction. The development of the discs consequently has a configuration which corresponds to the portion defined by dark solid lines and designated a in FIG. 1. The surface area of the discs must be designed in correspondence with the spacing of the hexagon sides in longitudinal direction, as well as the inclination and curvature of the flat angle step ramp. Conventional milling machines may be employed and engraving is superfluous in the manufacture of a plane die or an embossing roller since no depressions without escape need be made. Therefore, the embossing tools can be made at much lower costs than for the previous, known solutions. Also, the manufacture is simpler, and no special workshop is needed, such as for engraving rollers. This is a great advantage also in the testing and prototype stages since an expensive roller need not be prepared.

The push-off and gliding behavior of ski base coatings depends to a great deal on the length of the step edges extending transversely of the push-off direction and on their number per unit area. For this reason the embossing of the base coating throughout a ski length, preferably, is made such that the hexagon fields will be longer in a direction transversely of the push-off direction or longitudinal direction of the coating than in a direction parallel to the push-off direction or longitudinal direction of the coating in the central portion of the coating, in other words in that part which will come to lie below the shoe, specifically the ball of the foot upon joining with the body of the ski. In the gliding zones, in other words in those parts of the coating which come to lie in the front and rear portions of the cross-country ski, the embossing is just the opposite or as shown in FIG. 4. The push-off effect is less important in these areas.

Figure 5:
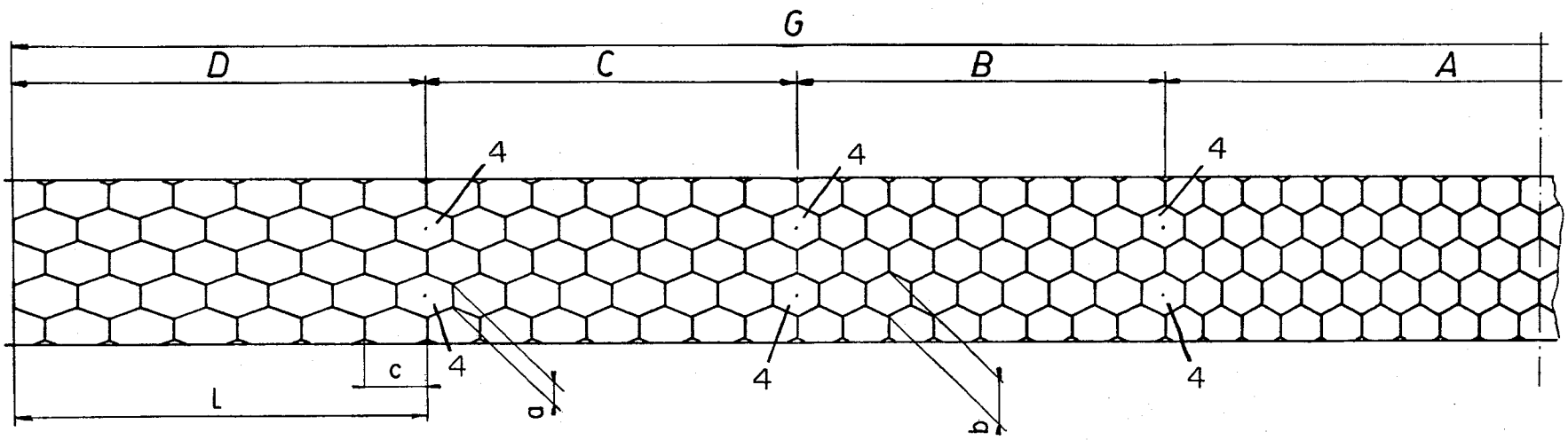
FIG. 5 is a longer partial plan view of a ski base coating according to the invention.

As shown in FIG. 5, the above aim can be realized very simply by giving the hexagon fields different lengths in different longitudinal sections A, B, C, D, maintaining the same width throughout. In this manner the number of step edges disposed transversely of the push-off direction per unit area varies and can be adapted easily to the above mentioned requirements. A central section A of a ski base coating embossed across the entire length of the ski, which section contains equilateral hexagon fields, is followed at either end by three sections B, C, D in which the length of the hexagon fields increases progressively in push-off direction or in the longitudinal direction of the coating. It should be noted that the width of the hexagon fields does not vary so that the ski base coating can be made in simple manner by the method of the invention.

In the embodiment shown in FIG. 5 the central section A of the ski base coating is characterized by equilateral hexagon fields. Yet, as mentioned before, the hexagon fields in the central section A of the coating could also be shorter in push-off direction or longitudinal direction of the coating than in a direction transversely of the push-off direction or longitudinal direction of the coating.

As readily apparent from FIG. 5, a sequence of fields of different widths would not be possible unless non-hexagonal, non-symmetrical fields were positioned in between which, if provided with step-like edges, would be directed partly against the gliding direction. It is an accomplishment of the invention that it was recognized as being advantageous to keep a constant width of the hexagon fields and to vary only their length, i.e. their longitudinal extension in push-off direction. Within each section A, B, C, and D all hexagon fields are the same and they are all biaxially symmetrical. It is only the fields 4 marked by a dot in the transitory zones which are mono-axially symmetrical so as to permit a continuous transition from one field length to another.

In FIG. 5 the width of the coating is not chosen such that there are transverse hexagon sides along the margins. However, as explained above, the embodiment in which there are transverse hexagon sides along the margins is especially advantageous as regards the push-off effect. But also the embodiment according to FIG. 5 is characterized by much better push-off effect than the known ski base coatings discussed initially.

The table belonging to FIG. 5 lists dimensions of the sections A, B, C, D and of the hexagon fields which proved especially advantageous when tested in practice. In the table:

l=length of sections A, B, C, D, and G (=A+B+C+D)

a=length of hexagon sides extending transversely of push-off direction or longitudinal direction of coating b=maximum transverse extension of hexagon fields c=longitudinal extension of hexagon fields in the individual coating sections A, B, C, D n=number of hexagon fields per longitudinal row of sections A, B, C, or D.

The values of l, a, b, and c indicated in the table are given in millimeters.

Only half of section A is to be seen in FIG. 5.

All features disclosed in the present documents are claimed as essential for the invention to the extent that they are novel, individually or in combination, in comparison with the state of the art.

What is claimed is:

1. A ski base coating including a push-off aid which comprises a plurality of steps having steep gradient push-off flanks in a push-off direction and flat angle ramps in a gliding direction, the upper side of the steps being formed of a continuous honeycomb arrangement of hexagonal fields (2', 2''), each having sides and a hexagon face, wherein the fields (2', 2'') are so arranged that one of the hexagon sides (1', 1'') each extends transversely of the push-off direction, that said hexagon side (1', 1'') is designed as a push-off edge, and that the hexagon faces form the flat angle step ramps.

2. The ski base coating as claimed in claim 1, wherein the upper side of the individual steps is inclined or curved differently in longitudinal direction in different sections of its length.

3. The ski base coating as claimed in claim 1 or 2, wherein at least part sections of the hexagon sides (3) extending obliquely to the push-off direction adjacent the hexagon sides which extend transversely of the push-off direction and are formed as push-off edges are also formed as push-off edges.

4. The ski base coating as claimed in claim 1, wherein the side length of the hexagon sides formed as push-off edges (1', 1''; 3) is between 4 and 15 mm.

5. The ski base coating as claimed in claim 1, wherein the depth of the steps is between 0.1 to 1.0 mm.

6. The ski base coating as claimed in claim 1, wherein the push-off aid is present only in part sections of the ski length.

7. The ski base coating as claimed in claim 1, wherein the hexagonal fields are equilateral hexagonal fields.

8. The ski base coating as claimed in claim 1, wherein the hexagonal fields are biaxially symmetric hexagonal fields.

9. The ski base coating as claimed in claim 4, wherein the ski containing the ski base coating has a width of less than 55 mm in the central range of the ski.

10. The ski base coating as claimed in claim 1, wherein the width of the hexagon sides (1', 1'') is a constant width, and wherein the longitudinal length of the hexagonal fields varies in the push-off direction.

11. The ski base coating as claimed in claim 1, wherein the width of the hexagon sides (1', 1'') is a constant width, and wherein the longitudinal length of the hexagonal fields increases progressively in the push-off direction.

12. The ski base coating as claimed in claim 1, wherein the ski base coating is generally the length of the ski, with the central section beneath the foot of the skier containing equilateral hexagonal fields, with sections at each end of the central section in which the length of the hexagonal fields increases progressively in the push-off direction, while the width of the hexagon sides (1', 1'') of the hexagonal fields is of constant width in all the sections.

13. The ski base coating as claimed in claim 1, wherein the transverse hexagon sides extend generally along each edge margin of the ski base coating.

14. The ski base coating as claimed in claim 1, wherein the hexagon side (1'') is offset from the hexagon side (1') by one-half a side spacing.

15. The ski base coating as claimed in claim 1, wherein the hexagon sides (1', 1'') are in substantial longitudinal alignment and the ski base coating is free of acute angle intersections.

16. The ski base coating as claimed in claim 1, wherein the hexagon sides (1', 1'') have a constant width, and the ski base coating comprises a hexagonal field central section A followed at each end by hexagonal field sections B, C and D in which the length of the hexagonal fields increases progressively and wherein the dimensions of sections A, B, C and D are set forth as follows:

| | l | a | b | c | n |
|---|---|---|---|---|---|
| A | 197.45 | 6 | 12 | 10.39 | 19 |
| B | 96 | 6 | 12 | 12.0 | 8 |
| C | 98 | 6 | 12 | 14.0 | 7 |
| D | 104 | 6 | 12 | 16.0 | 6.5 |
| G | 793.45 | | | | |

wherein l=length of sections A,B,C,D and G (=A+B+C+D);

a=length of hexagon sides extending transversely of push-off direction or longitudinal direction of coating;

b=maximum transverse extension of hexagon fields;

c=longitudinal extension of hexagon fields in the individual coating sections A, B, C and D; and n=number of hexagon fields per longitudinal row of sections A, B, C or D, and wherein the values of a, b and c are in millimeters.

17. A cross-country ski having a ski base coating as claimed in claim 1.

18. A cross-country ski having a ski base coating as claimed in claim 12.

19. A ski base coating including a push-off aid, which ski base coating comprises a plurality of steps having steep gradient push-off flanks in a push-off direction and flat angle ramps in the gliding direction, the upper sides of the steps being formed of a continuous honeycomb-like arrangement of hexagonal fields (2', 2''), each field having hexagon sides and a hexagon face, wherein said hexagonal fields are so arranged that a first one of the hexagon sides (1', 1'') each extends transversely of the push-off direction, that said first hexagon sides (1', 1'') are designed as a push-off edge, and that the hexagon faces form the flat angle step ramps, wherein the depth of the steps is between 0.1 and 1.0 mm, wherein at least part sections of some second the hexagon sides (3) extend obliquely to the push-off direction, adjacent the said first hexagon sides (1', 1''), and are also formed as push-off edges, and wherein the said first hexagon sides (1', 1'') extend to each edge margin of the ski base coating, and the said first hexagon sides (1', 1'') are of constant width, and wherein each of said first hexagon sides (1', 1'') are in respective longitudinal alignment.

20. The ski base coating as claimed in claim 19, wherein the hexagonal fields in the central section underneath the foot of the skier comprise equilateral hexagonal fields, and wherein the ski base coating comprises biaxially symmetrical hexagonal field sections at each end of the central section, with the length of the biaxially symmetrical hexagonal fields progressively increasing in length from the central section.

21. A cross-country ski which contains the ski base coating of claim 19.

* * * * *